US007644665B2

(12) United States Patent
Creighton et al.

(10) Patent No.: US 7,644,665 B2
(45) Date of Patent: Jan. 12, 2010

(54) KNOCKDOWN PALLET STRUCTURE, AND METHOD OF ERECTING AND KNOCKING-DOWN THE SAME

(75) Inventors: Thomas W. Creighton, Winnipeg (CA); Selamawit T. Desta Rogowsky, Winnipeg (CA); Edward J. Cavenagh, Winnipeg (CA)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/379,459

(22) Filed: Feb. 23, 2009

(65) Prior Publication Data

US 2009/0158972 A1 Jun. 25, 2009

Related U.S. Application Data

(62) Division of application No. 12/007,995, filed on Jan. 18, 2008, now Pat. No. 7,516,706, which is a division of application No. 11/129,316, filed on May 16, 2005, now abandoned.

(51) Int. Cl.
*B65D 19/12* (2006.01)

(52) U.S. Cl. ..... 108/56.3; 108/57.22; 108/67

(58) Field of Classification Search ..... 108/51.11, 108/54.1, 55.1, 55.3, 56.1, 56.3, 57.25, 57.27, 108/67, 161, 57.22; 206/386, 600, 599; 248/346.3, 346.4, 346.02
See application file for complete search history.

(56) References Cited

U.S. PATENT DOCUMENTS 154,126 A * 8/1874 Cotton ..... 108/43
283,119 A * 8/1883 Knapp ..... 108/171
981,114 A * 1/1911 Ridgely ..... 108/67
2,643,080 A * 6/1953 Vogel ..... 108/51.3
2,774,490 A * 12/1956 Strong ..... 108/51.3
2,841,350 A * 7/1958 Chronister ..... 108/56.3
2,928,638 A * 3/1960 O'C Parker ..... 108/51.3
3,036,802 A * 5/1962 Kitchell ..... 108/51.3
3,112,715 A * 12/1963 Callahan et al. ..... 108/51.3
3,884,159 A * 5/1975 Faria ..... 108/67
4,026,219 A * 5/1977 Shupe et al. ..... 108/62
4,234,973 A * 11/1980 Vetter et al. ..... 108/68
4,392,437 A * 7/1983 Wallace ..... 108/172

(Continued)

*Primary Examiner*—José V Chen
(74) *Attorney, Agent, or Firm*—Law Offices of Steven W. Weinrieb

(57) ABSTRACT

A new and improved knockdown pallet structure comprises a relatively flexible base panel which is fabricated from a suitable woven plastic material, such as, for example, polypropylene, and a pair of laterally spaced, longitudinally extending pockets are secured upon undersurface portions of the base panel so as to accommodate rigid support members, which may comprise rigid thermoplastic tubes or pipes, for accommodating the fork tines of a forklift truck when a pallet structure, having a palletized load disposed thereon, is to be lifted and transported. A pair of semi-rigid cross-brace members are respectively pivotally secured at first end portions thereof upon the pallet structure so as to be movable between a first operative position, at which the pair of semi-rigid cross-brace members will be disposed in a longitudinally spaced, laterally oriented mode, and a second position at which the pair of semi-rigid cross-brace members will be disposed in a laterally spaced, longitudinally oriented mode so as to be disposed parallel to the laterally spaced, longitudinally extending rigid support members in order to permit the entire pallet structure to be rolled up, folded, or otherwise knocked-down, for compact storage and transportation purposes.

13 Claims, 3 Drawing Sheets

U.S. PATENT DOCUMENTS 5,690,037 A * 11/1997 Hill ..... 108/51.3
5,884,566 A * 3/1999 Chen ..... 108/67
5,890,437 A * 4/1999 Hill ..... 108/51.3
6,125,771 A * 10/2000 Platt et al. ..... 108/115
6,973,882 B2 * 12/2005 Baechle et al. ..... 108/51.3
7,096,797 B2 * 8/2006 Sharpe et al. ..... 108/43
7,516,706 B2 * 4/2009 Creighton et al. ..... 108/56.3

* cited by examiner

KNOCKDOWN PALLET STRUCTURE, AND METHOD OF ERECTING AND KNOCKING-DOWN THE SAME

CROSS REFERENCE TO RELATED PATENT APPLICATIONS

This patent application is a divisional patent application of U.S. patent application Ser. No. 12/007,995 which is entitled KNOCKDOWN PALLET STRUCTURE, AND METHOD OF ERECTING AND KNOCKING-DOWN THE SAME, which was filed on Jan. 18, 2008, now U.S. Pat. No. 7,516,706 and which, in turn, is a divisional patent application of U.S. patent application Ser. No. 11/129,316 which is entitled KNOCKDOWN PALLET STRUCTURE, AND METHOD OF ERECTING AND KNOCKING-DOWN THE SAME, which was filed on May 16, 2005, now abandoned, the priority benefits of which are hereby claimed.

FIELD OF THE INVENTION

The present invention relates generally to pallet structures for supporting packages, articles, products, palletized loads, bales, or the like, and more particularly to a new and improved knock-down pallet structure, and a method of erecting and knocking-down the same, wherein the pallet structure comprises a base panel which is fabricated from a suitable woven plastic material, such as, for example, polypropylene, and wherein a pair of laterally or transversely spaced, longitudinally extending pockets or straps are secured upon undersurface portions of the base panel so as to accommodate rigid support members, which may comprise rigid thermoplastic tubes or pipes, for accommodating or housing the fork tines of a forklift truck when the pallet structure, along with the package, bale, article, product, palletized load, or the like, disposed thereon, is to be lifted and transported.

A pair of semi-rigid cross-brace members are respectively pivotally secured at first end portions thereof upon the pallet structure so as to be movable between a first operative assembled or erected position, at which the pair of semi-rigid cross-brace members will be disposed in a longitudinally spaced, laterally or transversely oriented position or mode wherein second opposite end portions of the pair of longitudinally spaced, laterally or transversely oriented semi-rigid members will be fixedly secured within pocket members formed upon the pallet structure so as to thereby effectively span the lateral or transverse distance defined between the laterally or transversely spaced, longitudinally extending rigid support members and thereby provide lateral or transverse support to the pallet structure within the regions defined between the transversely or laterally spaced, longitudinally extending rigid support members, and a second knocked-down position at which the pair of semi-rigid cross-brace members will have their second opposite end portions removed from the pocket members so as to be disposed in a non-secured state upon the pallet structure at which the pair of semi-rigid cross-brace members can be disposed in a transversely or laterally spaced, longitudinally oriented position or mode parallel to and atop the laterally or transversely spaced, longitudinally extending rigid support members in order to permit the entire pallet structure, disposed in its knocked-down state or mode, to be rolled up or folded for compact storage and transportation purposes.

BACKGROUND OF THE INVENTION

Conventional or prior art pallet structures are commonly seen and used within commercial warehouses and distribution centers, home appliance retail stores, and many other large commercial or industrial facilities, in order to support and transport large-sized packages, bales, articles, products, palletized loads, or the like. Such conventional or prior art pallet structures, however, comprise rigid structures which are commonly fabricated from wood or plastic materials, and therefore, such conventional or prior art pallet structures comprise a considerable amount of weight. Accordingly, in view of the fact that the pallet structures are fabricated from materials which are quite dense and heavy, and since shipping costs are based upon the weight of the items being shipped, the costs involved in shipping or transporting the pallet structures from their manufacturing plants to distribution centers or end use facilities can be quite considerable. In addition, since such conventional or prior art pallet structures comprise rigid, substantially planar structures, they cannot be, and are not designed to be, readily knocked-down or disassembled so as to be rendered compact for transportation and storage purposes. These factors render the conventional or prior art pallet structures costly to fabricate, costly to transport due to their relatively large amount of weight, and costly to transport and store due to the fact that such planar pallet structures do not comprise knockdown structures which would otherwise facilitate the compact storage of the same.

A need therefore exists in the art for a new and improved pallet structure which is preferably light in weight and which is capable of being easily erected or assembled, and conversely, which is capable of being easily knocked-down or otherwise disassembled, whereby the pallet structure would be relatively economical to fabricate, economical to ship or transport, easy and economical to store, and quick and easy to erect or assemble for use as well as quick and easy to knock-down or disassemble for shipping, transportation, and storage.

SUMMARY OF THE INVENTION

The foregoing and other objectives are achieved in accordance with the teachings and principles of the present invention through the provision of a new and improved pallet structure which comprises a base panel, which is fabricated from a suitable woven plastic material, such as, for example, polypropylene, and wherein a pair of laterally or transversely spaced, longitudinally extending pockets or straps are secured upon undersurface portions of the base panel so as to accommodate a pair of laterally or transversely spaced, longitudinally extending rigid support members. The pair of laterally or transversely spaced, longitudinally extending rigid support members may comprise rigid thermoplastic tubes or pipes, fabricated, for example, from polyvinylchloride (PVC), wherein, in turn, the pair of laterally or transversely spaced, longitudinally extending rigid support members are adapted to accommodate or house the fork tines of a forklift truck when the pallet structure, along with the package, product, bale, article, palletized load, or the like, disposed thereon, is to be lifted and transported.

A third longitudinally extending rigid support member may be secured to an undersurface portion of the base panel, and an additional support panel may be secured atop the base panel in order to impart additional support to the overall pallet structure. In addition, a pair of semi-rigid cross-brace members are respectively pivotally secured at first end portions thereof upon the pallet structure so as to be movable between first operative, assembled, and second inoperative, knocked-down, or disassembled positions. When the pair of semi-rigid cross-brace members are disposed at their first operative assembled positions, the pair of semi-rigid cross-brace members will have their second opposite end portions thereof fixedly secured with additional pocket members formed upon the pallet structure whereby the pair of semi-rigid cross-brace members will extend in laterally or transversely oriented positions so as to thereby effectively span the lateral or transverse distance defined between the laterally or transversely spaced, longitudinally extending rigid support members and thus provide lateral or transverse support to the pallet structure within the regions defined between the transversely or late-rally spaced, longitudinally extending rigid support members.

Conversely, when the pair of semi-rigid cross-brace members are disposed at their second inoperative, knocked-down or disassembled positions, the second opposite end portions of the pair of semi-rigid cross-brace members will have been removed from the pocket members whereby the pair of semi-rigid cross-brace members will now be disposed in laterally or transversely spaced, longitudinally extending modes so as to be able to be disposed parallel to and atop the laterally or transversely spaced, longitudinally extending rigid support members in order to permit the entire pallet structure to be rolled up or folded for compact storage and transportation purposes. In this manner, the new and improved pallet structure is capable of being easily erected or assembled, and conversely, is capable of being easily knocked-down or disassembled so as to facilitate shipping and transportation, storage, and on-site use of the same.

BRIEF DESCRIPTION OF THE DRAWINGS

Various other features and attendant advantages of the present invention will be more fully appreciated from the following detailed description when considered in connection with the accompanying drawing, wherein.

DETAILED DESCRIPTION OF THE PREFERRED EMBODIMENT

Figure 1:
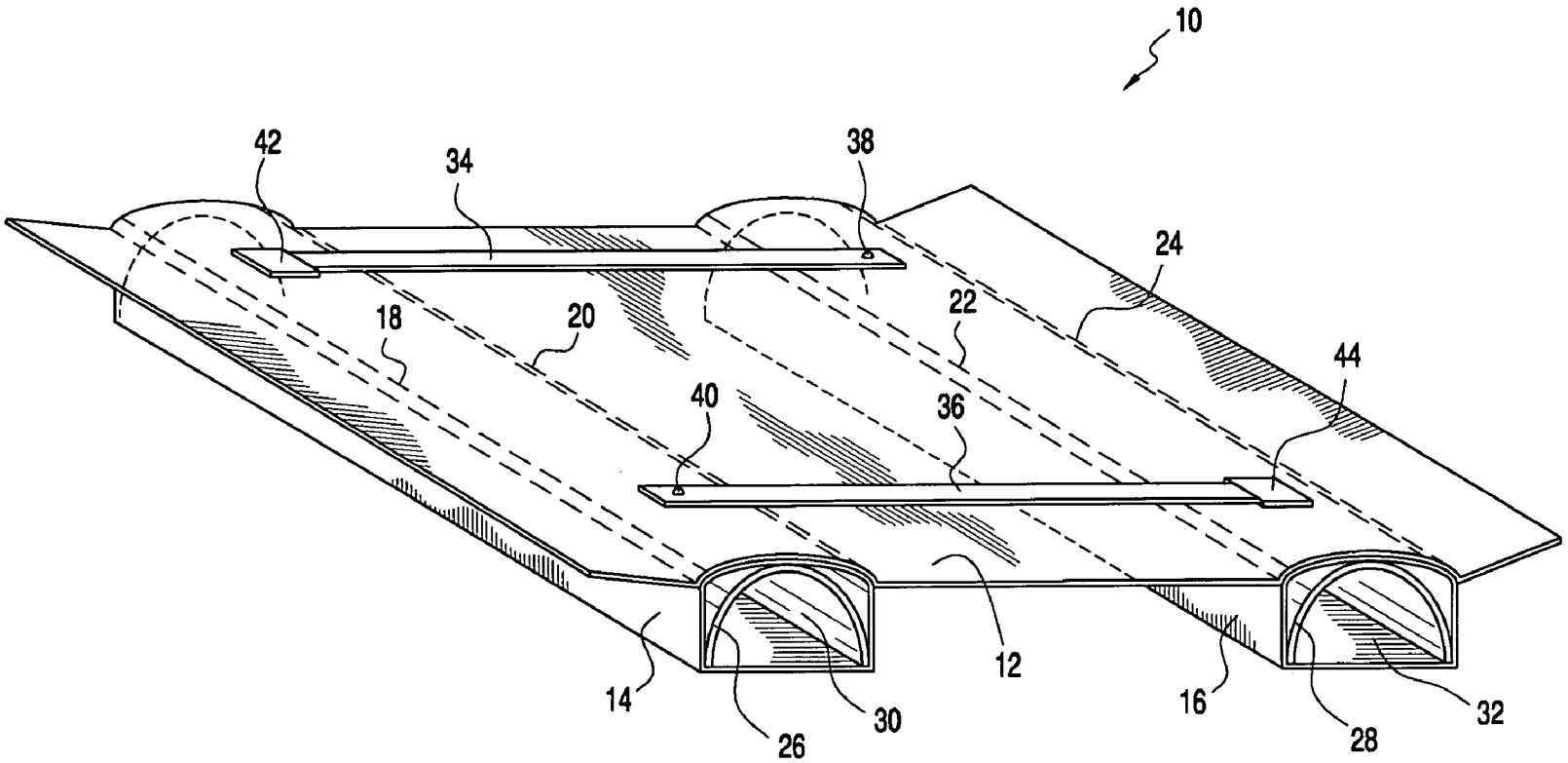
FIG. 1 is a perspective view of a first embodiment of a new and improved pallet structure which has been constructed in accordance with the principles and teachings of the present invention, which is light in weight, which is capable of being easily erected or assembled, and which, conversely is capable being easily knocked-down or disassembled so as to be folded or rolled up for shipping, transportation, or storage of the same.

Referring now to the drawings, and more particularly to FIG. 1 thereof, a first embodiment of the new and improved pallet structure, which has been constructed in accordance with the principles and teachings of the present invention, is disclosed and is generally indicated by the reference character 10. More particularly, the new and improved pallet structure 10 is seen to comprise a relatively flexible base panel 12 which is preferably fabricated as a woven fabric from a suitable plastic material, such as, for example, polypropylene. The relatively flexible base panel 12 will have a length dimension of approximately forty-two inches (42.00"), and a width dimension of approximately forty-two inches (42.00"), and in this manner, the base panel 12 effectively serves as the floor member of the pallet structure 10 for supporting the package, bale, article, product, palletized load, or the like, thereon. It is noted that while the particularly or specifically noted dimensions may be varied so as to suit particular or specific needs characteristic of, for example, particular or specific packages, bales, articles, products, palletized loads, or the like, the pallet structure base or floor member 12 having the noted dimensions will be proper so as to adequately support most packages, bales, articles, products, palletized loads, or the like, thereon.

A pair of laterally or transversely spaced, longitudinally extending pocket members 14,16, comprising, in effect, three-sided structures which are open at, at least, the front end portions thereof, are respectively secured to undersurface portions of the base panel 12 as a result of, for example, stitching the upper free end portions of the side wall portions of the laterally or transversely spaced, longitudinally extending pocket members 14,16 to the undersurface portions of the base panel 12 as denoted by means of the stitching loci 18,20 and 22,24. The pair of transversely or laterally spaced, longitudinally extending pocket members 14, 16 may be fabricated from a material which is the same as, or similar to and compatible with, the material used to fabricate the base panel 12 so as to be capable of being readily secured to the undersurface portions of the base panel 12 by means of the aforenoted stitching as denoted by means of the loci 18,20 and 22,24. As a result of the foregoing structural assembly, the pair of laterally or transversely spaced, longitudinally extending, three-sided pocket members 14,16 are able to accommodate a pair of laterally or transversely spaced, longitudinally extending rigid support members 26,28. Each one of the pair of laterally or transversely spaced, longitudinally extending rigid support members 26,28 has a substantially semi-circular cross-sectional configuration, although other cross-sectional configurations are of course possible, and each one of the pair of transversely or laterally spaced, longitudinally extending rigid support members 26,28 may comprise a rigid, thermoplastic tube or pipe which may be fabricated, for example, from polyvinylchloride (PVC).

The diametrical extent of each one of the pair of laterally or transversely spaced, longitudinally extending rigid support members 26,28 may be on the order of five inches (5.00"), while the longitudinal extent of each one of the pair of laterally or transversely spaced, longitudinally extending rigid support members 26,28 may be on the order of forty-two inches (42.00"), and it can therefore be appreciated that by respectively incorporating or inserting the pair of laterally or transversely spaced, longitudinally extending rigid support members 26,28 into the pair of transversely or laterally spaced, longitudinally extending pocket members 14, 16, the pair of laterally or transversely spaced, longitudinally extending rigid support members 26,28 effectively define passageways 30,32 into which, for example, the fork tines of a forklift truck can be inserted when the pallet structure 10, along with the package, bale, article, product, palletized load, or the like, disposed thereon, is to be lifted and transported. It is to be noted still further that the provision of the pair of laterally or transversely spaced, longitudinally extending pocket members 14,16 at fixed positions upon the pallet structure base panel 12, wherein the pair of laterally or transversely spaced, longitudinally extending pocket members 14,16 extend parallel with respect to each other, effectively serves to cause the pair of transversely or laterally spaced, longitudinally extending rigid support members 26,28 to be oriented and maintained in a parallel mode or state with respect to each other, when the pallet structure 10 is fully erected or assembled as will become more apparent hereinafter, so as to, in turn, ensure the fact that the fork tines of the forklift truck can in fact be readily inserted into the pair of transversely or laterally spaced, longitudinally extending rigid support members 26,28 when in fact the pallet structure 10, along with the package, bale, article, product, palletized load, or the like, disposed thereon, is to be lifted and transported.

With reference still being made to FIG. 1, and in accordance with additional principles and teachings of the present invention, another unique feature, characteristic of the new and improved pallet structure 10 of the present invention, resides in the fact that a pair of semi-rigid cross-brace members 34,36 are provided upon the upper surface portion of the pallet structure base panel 12. The pair of semi-rigid cross-brace members 34,36 may be fabricated from suitable plastic materials, such as, for example, ABS or polyvinylchloride (PVC). The pair of semi-rigid cross-brace members 34,36 are respectively pivotally secured at first diametrically opposite end portions thereof upon the upper surface portion of the pallet structure base panel 12 by means of suitable screw or bolt fasteners 38,40, wherein the screw or bolt fasteners 38,40 are adapted to be passed through the first diametrically opposite end portions of the pair of semi-rigid cross-brace members 34,36, through the upper surface portions of the pallet structure base panel 12, and into the upper crested portions of the pair of laterally or transversely spaced, longitudinally extending rigid support members 26,28. In this manner, the pair of semi-rigid cross-brace members 34,36 are movable between first operative or assembled positions, as illustrated, so as to be disposed in a longitudinally spaced, laterally oriented parallel mode with respect to each other, and second inoperative, knocked-down, or disassembled positions, not illustrated for clarity purposes, at which the pair of semi-rigid cross-brace members 34,36 will be disposed in a laterally or transversely spaced, longitudinally oriented parallel mode with respect to each other. Accordingly, when the pair of semi-rigid cross-brace members 34,36 are disposed at their second, knocked-down, or disassembled positions, the pair of semi-rigid cross-brace members 34,36 will be disposed atop the pair of transversely or laterally spaced, longitudinally extending rigid support members 26,28 so as to also be disposed parallel to the pair of laterally or transversely spaced, longitudinally extending rigid support members 26,28.

More particularly, each one of the semi-rigid cross-brace members 34,36 will have a width dimension of approximately two inches (2.00"), a length dimension of approximately thirty-six inches (36.00"), and a thickness dimension of approximately one quarter inch (0.025"). It is further seen that when the pair of semi-rigid cross-brace members 34,36 are disposed at their first operative, erected, or assembled positions so as to be disposed in their longitudinally spaced, laterally or transversely oriented parallel mode with respect to each other, the pair of longitudinally spaced, laterally or transversely oriented semi-rigid cross-brace members 34,36 will have their second opposite end portions thereof fixedly secured within additional pocket members 42,44 which are secured atop the upper surface portion of the pallet structure base panel 12. Conversely, when the pair of semi-rigid cross-brace members 34,36 are to be disposed at their second inoperative, knocked-down, or disassembled positions, not illustrated for clarity purposes, at which the pair of semi-rigid cross-brace members 34,36 will be disposed in the transversely or laterally spaced, longitudinally oriented parallel mode with respect to each other, the second opposite end portions of the pair of semi-rigid cross-brace members 34,36 will have been withdrawn from the pocket members 42,44. It is to be appreciated still further that when the pair of semi-rigid cross-brace members 34,36 are disposed at either one of their aforenoted first operative, erected, or assembled positions, at which the pair of semi-rigid cross brace members 34,36 will be disposed in their longitudinally spaced, laterally or transversely oriented parallel mode with respect to each other, or at their second inoperative, disassembled, or knocked-down positions at which the pair of semi-rigid cross-brace members 34,36 will be disposed in their laterally or transversely spaced, longitudinally oriented parallel mode with respect to each other, the pair of semi-rigid cross-brace members 34,36 serve or facilitate a variety of functions.

More particularly, when the pair of semi-rigid cross-brace members 34,36 are disposed at their aforenoted first operative, erected, or assembled positions at which the pair of semi-rigid cross-brace members 34,36 will be disposed in their longitudinally spaced, laterally or transversely oriented parallel mode with respect to each other, the pair of longitudinally spaced, laterally or transversely oriented semi-rigid cross-brace members 34,36 will, firstly, dispose and maintain the laterally or transversely spaced, longitudinally extending rigid support members 26,28 at their predeterminedly desired laterally or transversely spaced, longitudinally extending positions so as to be ready for the insertion thereinto of the fork tines of a forklift truck when, for example, the pallet structure 10, along with the package, bale, article, product, palletized load, or the like, disposed thereon, is to be lifted and transported. Secondly, the pair of longitudinally spaced, laterally or transversely oriented semi-rigid cross-brace members 34,36 will effectively provide lateral or transverse support, that is, the pair of longitudinally spaced, laterally or transversely oriented semi-rigid cross-brace members 34,36 will provide a predetermined amount of rigidity, to the pallet structure 10 as a result of extending between the laterally or transversely spaced, longitudinally extending rigid support members 26,28, such that the pallet structure 10 does not exhibit excessive sagging when a particular package, bale, article, product, palletized load, or the like, is disposed thereon.

Conversely, when the pair of semi-rigid cross-brace members 34,36 are disposed at their second inoperative, knocked-down, or disassembled positions, the second opposite end portions of the pair of semi-rigid cross-brace members 34,36 will have been removed from the pocket members 42,44 and the pair of semi-rigid cross-brace members will be able to be pivoted around the pivotal axes defined by means of the fastener screws or bolts 38,40 so as to now be disposed in their laterally or transversely spaced, longitudinally extending mode wherein the pair of laterally or transversely spaced, longitudinally extending semi-rigid cross-brace members 34,36 will now be disposed parallel to and atop the laterally or transversely spaced, longitudinally extending rigid support members 26, 28. In this manner, the entire pallet structure 10 is able to be rolled up or folded over upon itself for compact storage and transportation purposes.

While the mode of operation comprising the use of the new and improved pallet structure 10, constructed in accordance with the principles and teachings of the present invention, are submitted to be readily able to be appreciated, a brief description of the same will now be provided. Assuming that the new and improved pallet structure 10 has been previously knocked-down or disassembled, whereby the same would be rolled or folded up upon itself with respect to, for example, the longitudinal axes defined by means of the laterally or transversely spaced, longitudinally extending rigid support members 26,28, the pallet structure 10 is unrolled or unfolded so as to attain a substantially flat or planar disposition as illustrated within FIG. 1. The pair of semi-rigid cross-brace members 34,36, which have been disposed at their laterally or transversely spaced, longitudinally extending positions parallel to and atop the transversely or laterally spaced, longitudinally extending rigid support members 26,28, are now pivotally rotated around their first end portions which are pivotally secured to the pallet structure 10 by means of fasteners 38,40, such that the second end portions of the pair of semi-rigid cross-brace members 34,36 can now be incorporated within the pocket members 42,44. This completes the erection or assembly of the pallet structure 10, whereby the same is now ready to be used in conjunction with the support, hoisting or lifting, and transportation of packages, articles, products, palletized loads, bales, or the like. Conversely, when the particular service or operation of the pallet structure 10 has been completed, the pallet structure 10 may be simply knocked-down or disassembled by removing the second end portions of the pair of semi-rigid cross-brace members 34,36 from the pocket members 42,44, rotating the pair of semi-rigid cross-brace members 34,36 around the axes defined by means of the fasteners 38,40 so as to be disposed parallel to and atop the laterally or transversely spaced, longitudinally extending rigid support members 26,28, and rolling up the pallet structure 10 around a longitudinally oriented axis disposed parallel to the longitudinally extending rigid support members 26,28.

Figure 2:
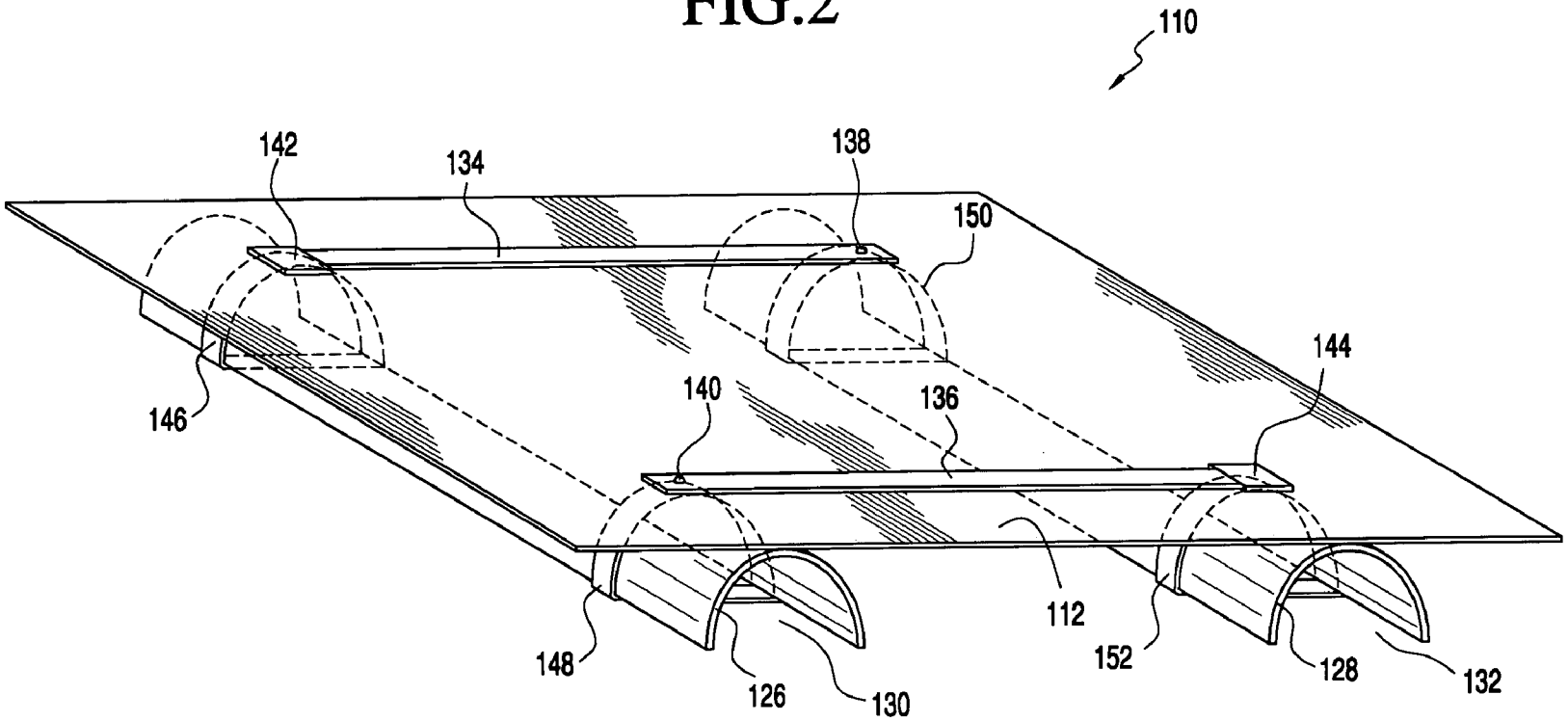
FIG. 2 is a perspective view of a second embodiment of a new and improved pallet structure which has also been constructed in accordance with the principles and teachings of the present invention, wherein the pallet structure is similar to the pallet structure as disclosed within FIG. 1, however, in lieu of the pair of laterally or transversely spaced, longitudinally extending pocket members secured to the undersurface portions of the base panel for respectively accommodating the pair of laterally or transversely spaced, longitudinally extending rigid support members, a pair of longitudinally spaced strapping members are secured to under-surface portions of the base panel for respectively accommodating each one of the pair of laterally or transversely spaced, longitudinally extending rigid support members.

With reference now being made to FIG. 2, a second embodiment of a pallet structure, constructed in accordance with the principles and teachings of the present invention, is disclosed and generally indicated by the reference character 110. It is to be noted that the second embodiment pallet structure 110 is similar in structure to the first embodiment pallet structure 10 as disclosed within FIG. 1, except as will be noted hereinafter, and therefore the detailed description of the second embodiment pallet structure 110 will be confined to the structural differences existing between the first and second embodiment pallet structures 10, 110 as respectively disclosed within FIGS. 1 and 2. It is further noted that the various structural components of the second embodiment pallet structure 110, which correspond to those structural components of the first embodiment pallet structure 10, will be designated by similar reference characters except that they will be within the 100 series.

More particularly, then, it is seen that the only significant difference between the first and second embodiment pallet structures 10,110 resides in the fact that the pair of laterally or transversely spaced, longitudinally extending pocket members 14,16, for accommodating the laterally or transversely spaced, longitudinally extending rigid support members 26,28, have effectively been eliminated, and in lieu thereof, first and second pairs of longitudinally spaced straps 146,148, and 150,152, are respectively secured to undersurface portions of the pallet structure base panel 112 for respectively accommodating each one of the transversely or laterally spaced, longitudinally extending rigid support members 126, 128. It can of course be appreciated that by utilizing the first and second pairs of longitudinally spaced, semi-circular straps 146,148 and 150,152, in lieu of the pair of laterally or transversely spaced, longitudinally extending pocket members 14,16, upon the undersurface portions of the pallet structure base panel 112, the same operational attributes, as provided or demonstrated by means of the pair of laterally or transversely spaced, longitudinally extending pocket members 14,16, that is, the housing and accommodating of the pair of transversely or laterally spaced, longitudinally extending rigid support members 126,128, and the maintaining the pair of transversely or laterally spaced, longitudinally extending rigid support members 126,128 parallel with respect to each other so as to, in turn, ensure the fact that the fork tines of the forklift truck can in fact be readily inserted into the pair of transversely or laterally spaced, longitudinally extending rigid support members 126, 128 when the pallet structure 110, along with the package, bale, article, product, palletized load, or the like, disposed thereon, is to be lifted and transported, can likewise be achieved. It is to be noted that while the straps 146,148, and 150,152 appear to have semi-circular configurations, the straps 146,148, and 150,152 are actually originally circular in cross-section but conform to the semi-circular cross-sectional configurations of the rigid support members 126,128.

Figure 3:
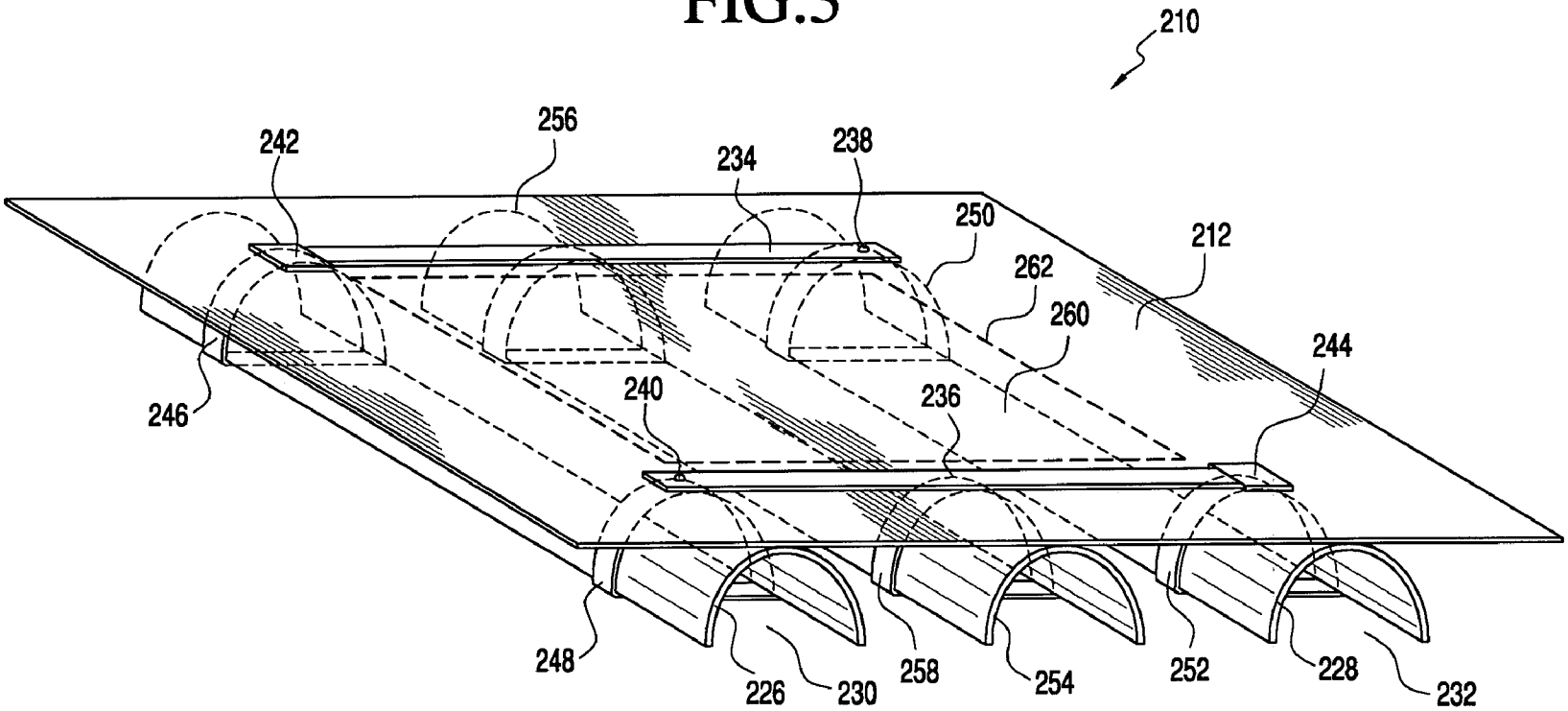
FIG. 3 is a perspective view of a third embodiment of a new and improved pallet structure which has also been constructed in accordance with the principles and teachings of the present invention, wherein the pallet structure is similar to the pallet structure as disclosed within FIG. 2, however, in lieu of the provision of only the two laterally or transversely spaced, longitudinally extending rigid support members secured to the undersurface portions of the base panel, three laterally or transversely spaced, longitudinally extending rigid support members are utilized in order to impart additional support to the overall pallet structure in connection with substantially heavy palletized loads.

With reference now being made to FIG. 3, a third embodiment of a pallet structure, constructed in accordance with the principles and teachings of the present invention, is disclosed and generally indicated by the reference character 210. It is to be noted that the third embodiment pallet structure 210 is similar in structure to the first and second embodiment pallet structures 10,110 as disclosed within FIGS. 1 and 2, except as will be noted hereinafter, and therefore the detailed description of the second embodiment pallet structure 210 will be confined to the structural differences existing between the first, second, and third embodiment pallet structures 10,110, 210 as respectively disclosed within FIGS. 1,2, and 3. It is further noted that the various structural components of the third embodiment pallet structure 210, which correspond to those structural components of the first and second embodiment pallet structures 10,110 will be designated by similar reference characters except that they will be within the 200 series. More particularly, then, it is seen that the only significant differences between the third embodiment pallet structure 210, as compared to the first and second embodiment pallet structures 10,110 resides in the fact that, in addition to the use of the pair of transversely or laterally spaced, longitudinally extending rigid support members 226, 228 that are adapted to house the fork tines of the forklift vehicle when the forklift vehicle is to lift and transport the pallet structure 210, a third longitudinally extending rigid support member 254 is adapted to be secured to the undersurface portion of the base panel 212, by means of an additional pair of longitudinally spaced straps 256,258, such that the third longitudinally extending rigid support member 254 is interposed between, and extends parallel to, the pair of transversely or late-rally spaced, longitudinally extending rigid support members 226, 228. While the third longitudinally extending rigid support member 254 does not interact with, or accommodate, one of the fork tines of the forklift vehicle, the additional longitudinally extending rigid support member 254 provides enhanced structural support to the overall pallet structure 210 whereby packages, articles, pro-ducts, palletized loads, bales, or the like, having significant or substantial weight, can be properly and adequately supported without the pallet structure 210 exhibiting any significant sagging within the central portion thereof.

Continuing further, and in order to provide the overall pallet structure 210 with still yet additional support, another additional feature characteristic of the third embodiment pallet structure 210 resides in the provision of an auxiliary support panel 260 which is removably mounted atop the base panel 212 within a pocket 262. The auxiliary support panel 260 and the pocket 262 have a longitudinal extent which is less than the distance defined between the two semi-rigid cross-brace members 234,236 when the two semi-rigid cross-brace members 234,236 are disposed in their operative, assembled or erected positions, and the lateral or transverse extent of the pocket 262 and the auxiliary support panel 260 is such as to be less than the distance defined between the two pivot points of the fasteners 238, 240. In this manner, the provision or presence of the pocket 262, with the auxiliary support panel 260 disposed therein, does not interfere with the disposition of the semi-rigid cross-brace members 234, 236 when they are disposed at either one of the first, operative erected or assembled position, or the second, inoperative, knocked-down or disassembled position. It is of course to be appreciated that when the pallet structure 210 is disposed in its knocked-down or disassembled state, the auxiliary support panel 260 is removed from the pocket 262, whereas when the pallet structure 210 is disposed in its erected or assembled state, the auxiliary support panel 260 is inserted into the pocket 262. It is to be noted that the auxiliary support panel 260 may be fabricated from suitable stiffener materials, such as, for example, cardboard, corrugated cardboard, or a suitable plastic material, such as, for example, ABS or polyvinylchloride (PVC), and the panel may either have a solid or honeycomb structure.

Thus, it may be seen that in accordance with the principles and teachings of the present invention, there has been provided a new and improved pallet structure which comprises a base panel, which is fabricated from a suitable woven plastic material, such as, for example, polypropylene, and wherein a pair of laterally or transversely spaced, longitudinally extending pockets, or a pair of longitudinally spaced strap members, are secured upon undersurface portions of the base panel so as to accommodate a pair of laterally or transversely spaced, longitudinally extending rigid support members. The pair of transversely or laterally spaced, longitudinally extending rigid support members may comprise rigid thermoplastic tubes or pipes, fabricated, for example, from polyvinylchloride (PVC), wherein, in turn, the pair of laterally or transversely spaced, longitudinally extending rigid support members are adapted to accommodate or house the fork tines of a forklift truck when the pallet structure, along with the package, bale, article, product, palletized load, or the like, disposed thereon, is to be lifted and transported.

A third longitudinally extending rigid support member may also be secured to an undersurface portion of the base panel, and an additional support panel may be secured atop the base panel in order to impart additional support to the overall pallet structure. In addition, a pair of semi-rigid cross-brace members are respectively pivotally secured at first end portions thereof upon the pallet structure so as to be movable between first operative and second inoperative positions. When the pair of semi-rigid cross-brace members are disposed at their first operative, erected or assembled positions, the pair of semi-rigid cross-brace members will have their second opposite end portions thereof fixedly secured within additional pocket members formed upon the pallet structure where-by the pair of semi-rigid cross-brace members will extend in laterally or transversely oriented positions so as to thereby provide lateral or transverse support to the pallet structure as a result of extending between the laterally or transverse-ly spaced, longitudinally extending rigid support tubes or pipes. Conversely, when the pair of semi-rigid cross-brace members are disposed at their second inoperative, knocked-down or disassembled positions, the second opposite end portions of the pair of semi-rigid cross-brace members will have been removed from the pocket members whereby the pair of semi-rigid cross-brace members will now be disposed in late-rally or transversely spaced, longitudinally extending modes so as to be able to be disposed parallel to and atop the laterally or transversely spaced, longitudinally extending rigid support members in order to permit the entire pallet structure to be rolled up or folded for compact storage and transportation purposes.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A knockdown pallet structure for facilitating the lifting and transportation of a load by means of a fork-lift vehicle, comprising:

a base panel having an upper surface portion and an undersurface portion, and defining a first plane when disposed within an operative state for supporting and transporting a load;

a pair of transversely spaced, longitudinally extending rigid support members, disposed upon said undersurface portion of said base panel, for accommodating the fork tines of a forklift vehicle;

means for securing said pair of transversely spaced, longitudinally extending rigid support members upon said undersurface portions of said base panel;

at least one elongated cross-brace member having a first end portion thereof attached to said upper surface portion of said base panel at a first predetermined location of said upper surface portion of said base panel; and pocket means fixedly mounted upon said upper surface portion of said base panel at a second predetermined location disposed transversely across from said first predetermined location at which said first end portion of said a least one elongated cross-brace member is attached to said upper surface portion of said base panel; and means for pivotally attaching said first end portion of said at least one elongated cross-brace member to said upper surface portion of said base panel at said first predetermined location such that said at least one elongated cross-brace member is pivotally movable with respect to said upper surface portion of said base panel within a second plane parallel to said first plane defined by said base panel when said base panel is disposed in its operative state, between a first inoperative, knockdown position, at which said at least one elongated cross-brace member is disposed atop said base panel so as to be oriented parallel to said pair of transversely spaced, longitudinally extending rigid support members so as to be operatively disconnected from said pair of transversely spaced, longitudinally extending rigid support members and thereby permit said knockdown pallet structure to attain a knocked-down compact state, and a second operative, erected position at which said first end portion of said at least one elongated cross-brace member is pivotally attached at said first end portion thereof to said first predetermined location of said upper surface portion of said base panel while a second end portion of said at least on elongated cross-brace member is fixedly disposed within said pocket means fixedly mounted upon said upper surface portion of said base panel at said second predetermined location transversely across from said first predetermined location at which said at first end portion of said at least one elongated cross-brace member is pivotally attached to said upper surface portion of said base panel such that said at least one elongated cross-brace member is disposed transversely with respect to said pair of transversely spaced, longitudinally extending rigid support members so as to operatively interconnect said pair of transversely spaced, longitudinally extending rigid support members together such that said erected pallet structure can support a load.

2. The pallet structure as set forth in claim 1, wherein:

said base panel comprises a woven fabric.

3. The pallet structure as set forth in claim 2, wherein:

said woven fabric comprises polypropylene.

4. The pallet structure as set forth in claim 1, wherein:

said pair of transversely spaced, longitudinally extending rigid support members comprise tubular pipe members.

5. The pallet structure as set forth in claim 4, wherein:

each one of said pair of transversely spaced, longitudinally extending tubular pipe members has a semi-circular cross-sectional configuration.

6. The pallet structure as set forth in claim 4, wherein:

each one of said pair of transversely spaced, longitudinally extending tubular pipe members is fabricated from polyvinylchloride (PVC).

7. The pallet structure as set forth in claim 1, wherein:

said at least one cross-brace member comprises a pair of cross-brace members which are pivotally attached upon said base panel at first end portions thereof so as to be disposed within a longitudinally spaced, transversely extending array when said pair of cross-brace members are disposed at said first operative, erected positions, and are disposed within a transversely spaced, longitudinally extending array when said pair of cross-brace members are disposed at said second inoperative, knocked-down positions.

8. The pallet structure as set forth in claim 7, wherein:

said pair of cross-brace members are pivotally mounted upon said base panel between said first operative, erected position and said second inoperative, knocked-down position.

9. The pallet structure as set forth in claim 8, further comprising:

pocket means fixedly mounted upon said base panel for fixedly securing said pair of cross-brace members at said first operative, erected positions.

10. The pallet structure as set forth in claim 1, wherein said means for securing said pair of transversely spaced, longitudinally extending rigid support members upon said undersurface portions of said base panel comprise: p1 a pair of transversely spaced, longitudinally extending pocket structures.

11. The pallet structure as set forth in claim 1, wherein said means for securing each one of said pair of transversely spaced, longitudinally extending rigid support members upon said undersurface portions of said base panel comprise:

a pair of longitudinally spaced straps.

12. The pallet structure as set forth in claim 1, further comprising:

a third longitudinally extending rigid support member interposed between said pair of transversely spaced, longitudinally extending rigid support members for imparting additional support to said pallet structure.

13. The pallet structure as set forth in claim 1, further comprising:

a pocket disposed atop said base panel; and an auxiliary support panel disposed within said pocket so as to provide said pallet structure with additional support.

* * * * *